US012173893B2

(12) United States Patent
Shaffer

(10) Patent No.: US 12,173,893 B2
(45) Date of Patent: Dec. 24, 2024

(54) CYLINDRICAL BURNER APPARATUS AND METHOD

(71) Applicant: GASTECH ENGINEERING LLC, Sapulpa, OK (US)

(72) Inventor: Yul E. Shaffer, Tulsa, OK (US)

(73) Assignee: GASTECH ENGINEERING LLC, Sapulpa, OK (US)

( * ) Notice: Subject to any disclaimer, the term of this patent is extended or adjusted under 35 U.S.C. 154(b) by 39 days.

(21) Appl. No.: 17/574,221

(22) Filed: Jan. 12, 2022

(65) Prior Publication Data

US 2022/0136694 A1 May 5, 2022

Related U.S. Application Data

(62) Division of application No. 16/927,610, filed on Jul. 13, 2020.

(51) Int. Cl.

| | |
|---|---|
| ***F23C 3/00*** | (2006.01) |
| ***F22B 9/00*** | (2006.01) |
| ***F23C 6/04*** | (2006.01) |
| ***F23C 9/00*** | (2006.01) |
| ***F23D 14/24*** | (2006.01) |

(Continued)

(52) U.S. Cl.

CPC ..... *F23C 3/002* (2013.01); *F23C 6/047* (2013.01); *F23C 9/006* (2013.01); *F23D 14/24* (2013.01); *F23D 14/60* (2013.01); *F23D 14/70* (2013.01); *F22B 9/00* (2013.01); *F23D 2209/20* (2013.01);

(Continued)

(58) Field of Classification Search

CPC ..... F23D 14/24; F23D 14/60; F23D 14/70; F23D 2209/20; F23D 2900/14003; F23D 2900/14004; F23C 3/002; F23C 6/047; F23C 9/006; F22B 9/00

See application file for complete search history.

(56) References Cited

U.S. PATENT DOCUMENTS 2,148,466 A * 2/1939 Hepburn ..... F23C 3/002 431/114

4,601,655 A 7/1986 Riley (Continued)

FOREIGN PATENT DOCUMENTS

| | | | | |
|---|---|---|---|---|
| DE | 3814897 | A1 * | 11/1989 | |
| DE | 4324298 | A1 * | 1/1995 | ..... F23C 9/006 |
| JP | 55123906 | | 9/1980 | |

OTHER PUBLICATIONS

PCT/US2021/39942—International Preliminary Report With International Search Report and Written Opinion; Dec. 9, 2021.

*Primary Examiner* — Jorge A Pereiro
*Assistant Examiner* — Logan P Jones
(74) *Attorney, Agent, or Firm* — Dennis D. Brown; Brown Patent Law, P.L.L.C.

(57) ABSTRACT

A cylindrical burner apparatus and method which produce low $NO_x$ emissions and low noise levels without being dependent upon a blower, or natural draft, for providing air flow or flue gas recirculation. A flow of combustion air is induced into an initial tube pass of the burner by discharging a gas fuel from a plurality of discharge ports located in the initial tube pass. At the same time, a flow of recycled flue gas is induced through a bypass duct between a subsequent tube pass of the burner and the initial tube pass by discharging one or more jets of gas fuel through the bypass duct.

4 Claims, 11 Drawing Sheets

(51) Int. Cl.
*F23D 14/60* (2006.01)
*F23D 14/70* (2006.01)
*F23C 9/06* (2006.01)

(52) U.S. Cl.
CPC ..... *F23D 2900/14003* (2013.01); *F23D 2900/14004* (2013.01)

(56) References Cited

U.S. PATENT DOCUMENTS

| | | | | |
|---|---|---|---|---|
| 4,828,483 | A | 5/1989 | Finke | |
| 4,983,118 | A | 1/1991 | Hovis | |
| 4,989,549 | A | 2/1991 | Korenberg | |
| 5,209,187 | A | 5/1993 | Khinkis | |
| 5,775,317 | A | 7/1998 | Finke | |
| 6,872,070 | B2 | 3/2005 | Moore | |
| 6,890,172 | B2 | 5/2005 | Stephens et al. | |
| 6,971,336 | B1 | 12/2005 | Chojnacki et al. | |
| 7,363,756 | B2 | 4/2008 | Carrea et al. | |
| 8,113,821 | B2 | 2/2012 | Feese et al. | |
| 10,386,061 | B2 | 8/2019 | Hong | |
| 2005/0247300 | A1 | 11/2005 | Collier | |
| 2006/0057516 | A1 | 3/2006 | Miller et al. | |
| 2014/0230701 | A1* | 8/2014 | Cheng | F23D 14/04 239/316 |
| 2019/0186732 | A1 | 6/2019 | Taylor | |

* cited by examiner

CYLINDRICAL BURNER APPARATUS AND METHOD

RELATED CASE

This application is a divisional of U.S. patent application Ser. No. 16/927,610 filed Jul. 13, 2020, and claims the benefit of the filing date thereof.

FIELD OF THE INVENTION

The present invention relates to cylindrical burner apparatuses and methods for water bath heaters, fire tube boilers and other applications.

BACKGROUND OF THE INVENTION

Cylindrically contained burner systems are commonly used, for example, in water bath heaters and in fire tube boilers. Fire tube boilers are typically used for steam generation. Water bath heaters are primarily used for such purposes as: preheating crude oil; heating gas and/or crude at the well head; controlling fuel gas dew points; heating high pressure hydrocarbon gas streams; heating fuel gases at power generation sites; heating high viscosity fluids to reduce pumping pressures; heating at compressor stations; vaporization of process fluids; and reboiler heating.

Fire tube boilers typically comprise a series of straight fire tubes that are housed inside a water-filled outer shell. As hot combustion gases flow through the fire tubes, they heat the water that surrounds the tubes to produce steam. Horizontal Return Tubular (HRT) type boilers typically comprise self-contained fire tubes with a separate combustion chamber. Scotch, Scotch marine, or shell type boilers typically comprise the fire tubes and combustion chamber being housed within the same shell. Depending on the construction details, fire tube boilers can have from one to as many as four burner tube passes or more.

Water bath heaters are indirect heaters which typically comprise: a vessel shell which is filled with water or other heat transfer bath media; two or more submerged fire tube passes (typically an initial pass and a return pass) which extend horizontally through a lower portion of the filled vessel; and a plurality of submerged process tube passes in an upper portion of the filled vessel for carrying the gas and/or liquid stream which is heated in the water bath heater. The term "indirect" refers to the fact that the submerged fire tube passes heat the bath media, which in turn heats the submerged coil containing the process stream. Usually, the bath fluid is water, but depending on the climate and heating requirements, it can also be oil or other thermal fluid, or a mixture of water and glycol.

In the fire tube burners heretofore used in the art, the air for the combustion process has been supplied to the burner by either (a) natural draft using a tall exhaust stack or (b) forced air flow using a blower.

When using a natural draft system, the height of the flue gas stack must be tall enough to provide sufficient draft to overcome the frictional pressure losses which occur through the stack, the fire tube passes, a stack arrestor, and a flame arrestor on the air inlet. The height of the stack increases the equipment and installation costs of the system and may create space and permitting problems.

Moreover, the tall stacks required for fire tube burners commonly contribute to combustion noise problems which can be severe, and even harmful, and can prevent the natural draft systems from being used in some locations. This phenomena, referred to as combustion "rumble," produces low-frequency pulsations that can be so severe as to: present undesirable sound levels for workers and others, both nearby and at a distance; shake loose electrical connections and terminations, including important safety devices; loosen or break mechanical fittings and connections; and cause structural damage to property and equipment.

As compared to natural draft, a forced air blower system (i) does not require a tall stack for producing draft, (ii) is less affected by changes in ambient conditions at the site, and (iii) can be sized to provide greater capacity and greater flame length. In addition, a line can be extended from the exhaust of the burner to the suction of the air blower to lower $NO_x$ emissions by providing Flue Gas Recirculation (FGR) to the combustion system.

Unfortunately, however, forced air blower systems are more expensive to purchase, operate, and maintain, produce increased carbon dioxide in the atmosphere as blower motors consume electrical power, and may not be feasible for use in remote areas having limited or no electrical power availability. In addition, forced air blower systems also produce significant noise levels. Moreover, although forced air blower systems can provide some FGR for reducing $NO_x$ emissions, further reductions in $NO_x$ emissions are still needed.

Consequently, a need exists for an improved fire tube burner apparatus and method which will: (a) eliminate the need for an elevated exhaust stack for providing natural draft, while also eliminating the need for a forced air blower system, (b) eliminate the combustion noise rumbling problems caused by natural draft systems, (c) produce much lower noise levels than forced air blower systems, and (d) provide further significant reductions in $NO_x$ and other emissions.

SUMMARY OF THE INVENTION

The present invention provides a cylindrical burner apparatus and method which satisfy the needs and alleviate the problems discussed above. The inventive cylindrical burner system provides increased FGR levels without the use of a blower. Moreover, the exhaust stack of the inventive cylindrical burner system need only be tall enough to prevent the exhaust from flowing into the air inlet. In addition, the inventive cylindrical burner system minimizes noise rumbling problems and is also quieter than the prior forced air systems. Also, the inventive cylindrical burner system provides significantly reduced $NO_x$ emission levels of less than 30 parts per million (ppm) (or even less than 20 ppm, or as low as 10 ppm or less, when optimized).

In one aspect, there is provided a method of operating a cylindrical burner, without forced air and without dependence on natural draft, while also producing low $NO_x$ emissions and low noise levels. The method preferably comprises the steps of: (a) inducing a flow of combustion air into a rearward end of an initial tube pass by discharging jets of a gas fuel from a plurality of fuel discharge ports positioned in the initial tube pass forwardly of the rearward end, and (b) inducing a flow of recycled flue gas from a subsequent tube pass into the initial tube pass, via a flue gas recirculation duct extending between the subsequent tube pass and the initial tube pass, by discharging one or more jets of the gas fuel which travel through the flue gas recirculation duct.

In another aspect, there is provided a cylindrical burner apparatus which preferably comprises: (a) an initial tube pass having a longitudinal axis and a rearward end; (b) a first fuel ejector structure or assembly, or an array of ejector elements, comprising a plurality of primary fuel jet discharge ports positioned in the initial tube pass forwardly of the rearward end, at least some of the primary fuel jet discharge ports discharging jets of a gas fuel which induce a flow of combustion air into the initial tube pass through the rearward end: (c) a subsequent tube pass downstream of the initial tube pass; (d) a flue gas recirculation duct having an inlet in fluid communication with an interior of the subsequent tube pass and a discharge in fluid communication with an interior of the initial tube pass; and (e) a second fuel ejection structure or assembly, or an array of ejector elements, comprising one or more secondary fuel jet discharge ports, each of the one or more secondary fuel jet discharge ports discharging a jet of the gas fuel which induces a flow of a recycled flue gas through the flue gas recirculation duct from the interior of the subsequent tube pass to the interior of the initial tube pass.

In another aspect of the cylindrical burner apparatus just described, at least most of the primary fuel discharge ports are preferably oriented to discharge a jet of the gas fuel in the initial tube pass (i) at a forward angle in the range of from 3° to 90° with respect to a plane extending through the discharge port which is perpendicular to the longitudinal axis and (b) at an angle, toward a direction of rotation of a swirling flame in the initial tube pass, in the range of from 30 to 90° with respect to a radial line, perpendicular to the longitudinal axis, which extends from the longitudinal axis through the discharge port. In addition, the cylindrical burner apparatus can also comprise (a) the forward angle of a plurality of the primary fuel discharge ports being in a range of from 45° to 90°, (b) the forward angle of a plurality of the primary fuel discharge ports being in a range of from 30° to 70°, and/or (c) the forward angle of a plurality of the primary fuel discharge ports being in a range of from 3° to 45°.

In another aspect, there is provided a cylindrical burner apparatus comprising: (a) a tube having a longitudinal axis and a rearward end; (b) an ejection structure or assembly, or an array of ejector elements, comprising a set of fuel jet discharge ports positioned in the tube forwardly of the rearward end, the fuel jet discharge ports discharging jets of a gas fuel which induce a flow of combustion air into the tube through the rearward end; and (c) a plurality of flame stabilization structures positioned in the tube downstream of the fuel jet discharge ports. At least some of the fuel jet discharge ports are preferably oriented such that the jets of the gas fuel discharged therefrom are directed toward the flame stabilization structures.

Further objects, features, and advantages of the present invention will be apparent to those in the art upon examining the accompanying drawings and upon reading the following detailed description of the preferred embodiments.

DETAILED DESCRIPTION OF THE PREFERRED EMBODIMENTS

Figure 1:
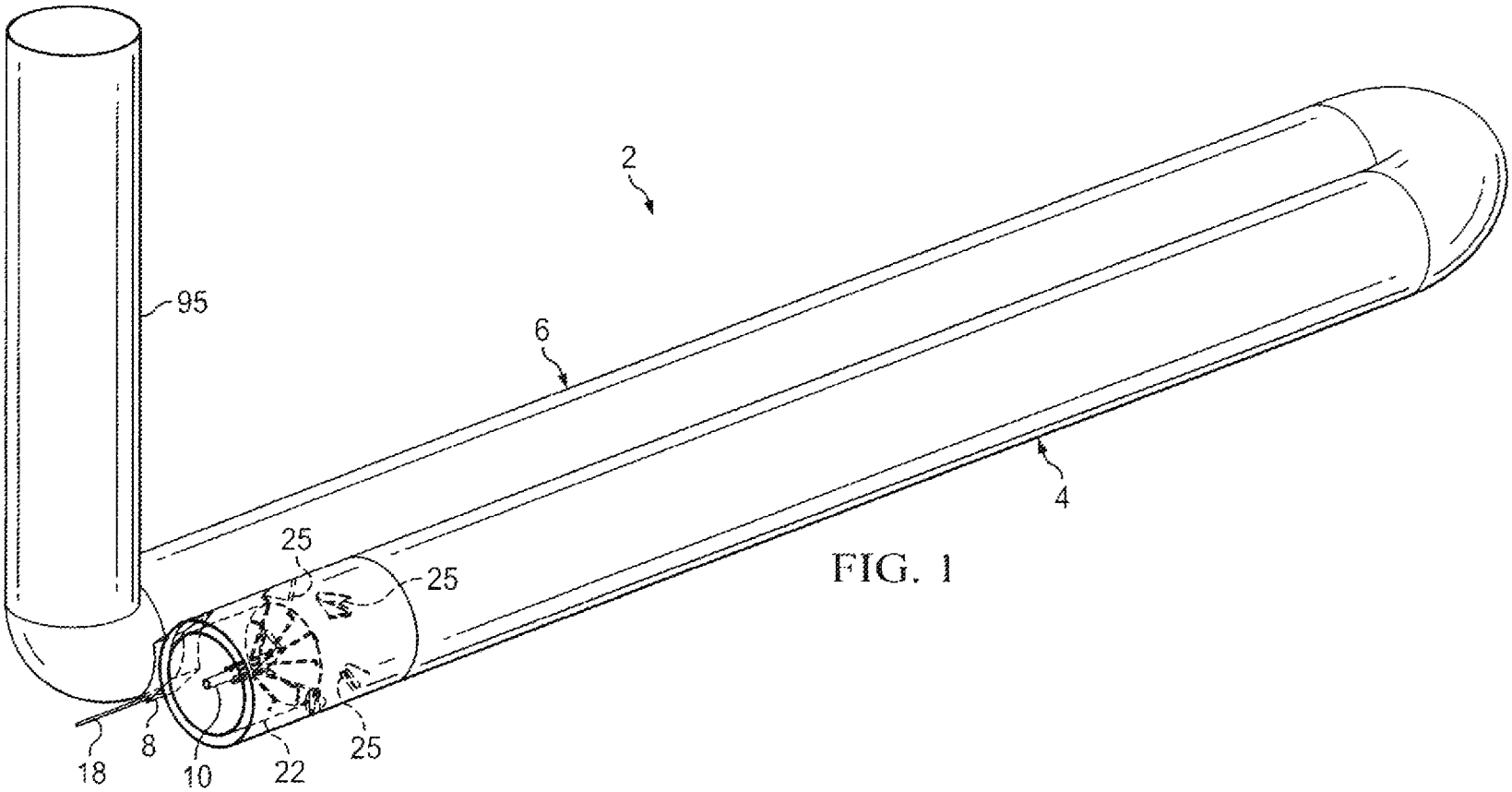
FIG. 1 is a perspective view of an embodiment 2 of the cylindrical burner apparatus provided by the present invention.

An embodiment 2 of the inventive cylindrical burner apparatus is illustrated in FIGS. 1-6. The inventive apparatus 2 preferably comprises: (i) an initial burner tube pass 4 having a longitudinal axis 5; (ii) a second, third or other subsequent burner tube pass 6, downstream of the initial tube pass 4, which is preferably adjacent and parallel to the initial pass 4; (iii) a flue gas recirculation (FGR) duct 8 which extends between the subsequent tube pass 6 and the initial tube pass 4; (iv) a first fuel ejection structure or assembly, or an array of ejector elements, 10 which provides a plurality of primary fuel jet discharge ports 12, 14, and/or 16; (v) a second fuel ejection structure or assembly, or an array of ejector elements, 18 which provides one or more secondary fuel discharge ports 20; (vi) a plurality of flame stabilization structures 25 positioned in the initial tube pass 4 downstream of the primary fuel jet discharge ports 12, 14 and 16; (vii) an interior sleeve 22 positioned in the rearward end portion of the initial tube pass 4; (viii) an interior annulus 24 which is formed in the initial tube pass 4 between the exterior wall 26 of the interior sleeve 22 and the interior wall 28 of the initial tube pass 4, and which surrounds the longitudinal axis 5; and (ix) a combustion air passageway 30 which extends longitudinally through the interior sleeve 22.

Figure 2:
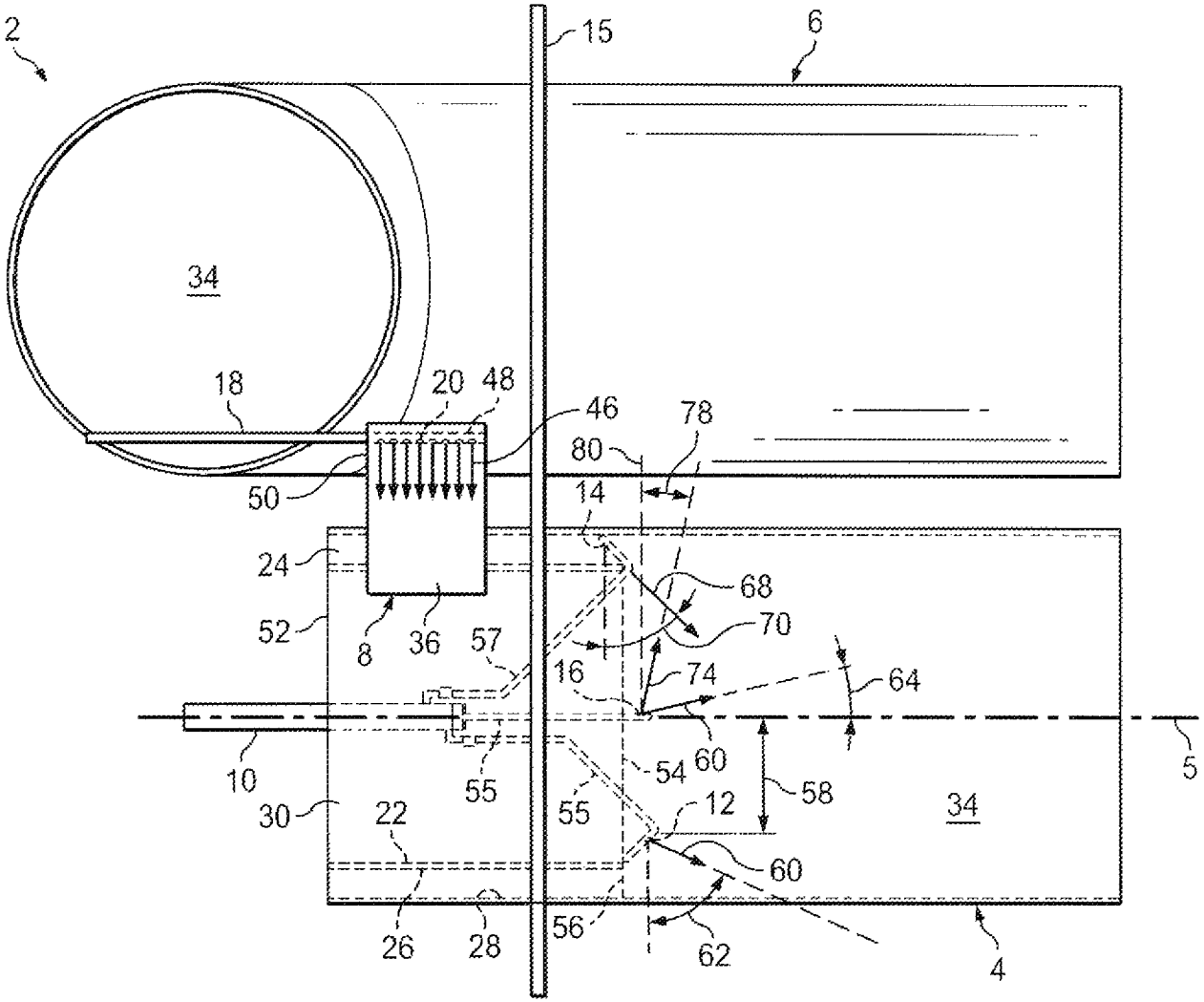
FIG. 2 is a cutaway top view of the inventive cylindrical burner apparatus 2.
Figure 3:
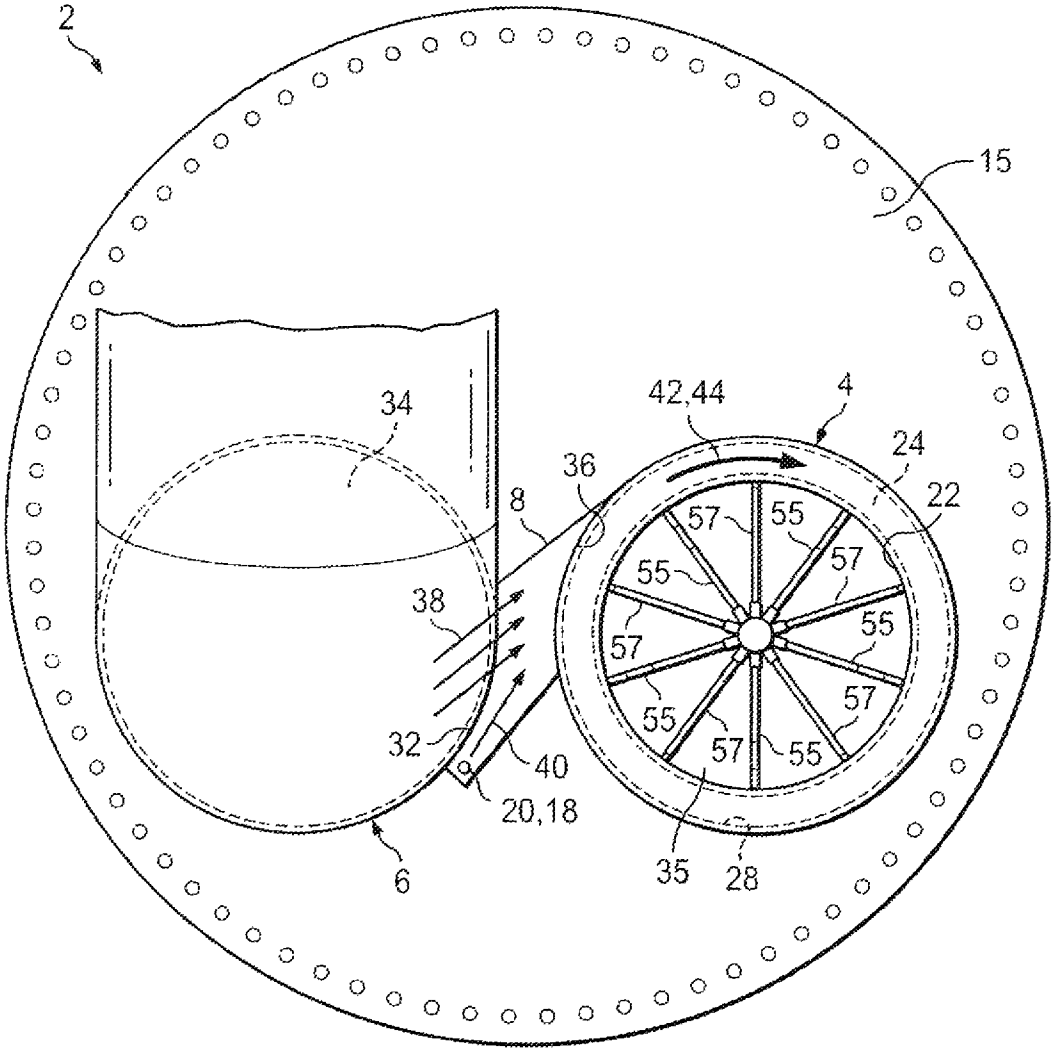
FIG. 3 is a cutaway rearward end view of the inventive cylindrical burner apparatus 2.

The initial tube pass 4 and the subsequent tube pass 6 can each be any type of pipe, duct or other conduit which is suitable for use in a fire tube burner. The initial tube pass 4 and the subsequent tube pass 6 will each preferably be an elongate cylindrical conduit. The inventive cylindrical burner apparatus 2 is illustrated in FIGS. 2 and 3 as installed in a bath heater 15.

The FGR duct 8 has (a) an inlet 32 which is in fluid communication with the interior 34 of the subsequent tube pass 6 and (b) a discharge 36 which is in fluid communication with the interior 35 of the initial tube pass 4. The inlet 32 of the FGR duct 8 is preferably located at an outlet end portion of the subsequent tube pass 6. The discharge 36 of the FGR duct 8 is preferably in fluid communication with the interior annulus 24 in the initial tube pass 4. The FGR duct 8 is also preferably oriented to deliver a flow of recycled flue gas 38 from the interior 34 of the subsequent tube pass 6, along with an inducing flow 40 of gas fuel from the one or more secondary fuel discharge ports 20, into the interior annulus 24 in a tangential orientation which causes the recycled flue gas 38 and the flow 40 of gas fuel to flow around and then out of the forward end 56 of the interior annulus 24 in a swirling flow regime 42 which encircles the longitudinal axis 5. The rearward end of the interior annulus 24 is preferably closed. The swirling flow 42 rotates in a direction of rotation 44.

The second fuel ejection structure, assembly, or array 18 can comprise any type of ejection structure or collection or arrangement of ejector elements which provides at least one, preferably a plurality of, secondary fuel jet discharge port(s) 20 for discharging one or more jets 46 of gas fuel which are effective for inducing the recycled flue gas stream 38 to flow through the FGR duct 8 from the interior 34 of the subsequent tube pass 6 to the interior 35 of the initial tube pass 4.

The secondary fuel jet discharge ports 20 can be provided by ejection nozzles, ejector tips, ejection flow apertures formed in gas pipes or conduits, other types of ejection structures or elements, or any combination thereof. The one or more secondary fuel jet discharge ports 20 can be located at, upstream of, and/or downstream of the inlet 32 of the FGR duct 8, or at any other location effective for inducing the flow of recycled flue gas 38 through the FGR duct 8. The second fuel ejection structure, assembly, or array 18 preferably comprises a manifold gas pipe having a distal end portion 48 which extends through a lateral side wall 50 of the FGR duct 8 and has a linear series of secondary fuel jet discharge ports 20 formed therein which traverse at least most of the lateral interior width of the FGR duct 8.

Figure 4:
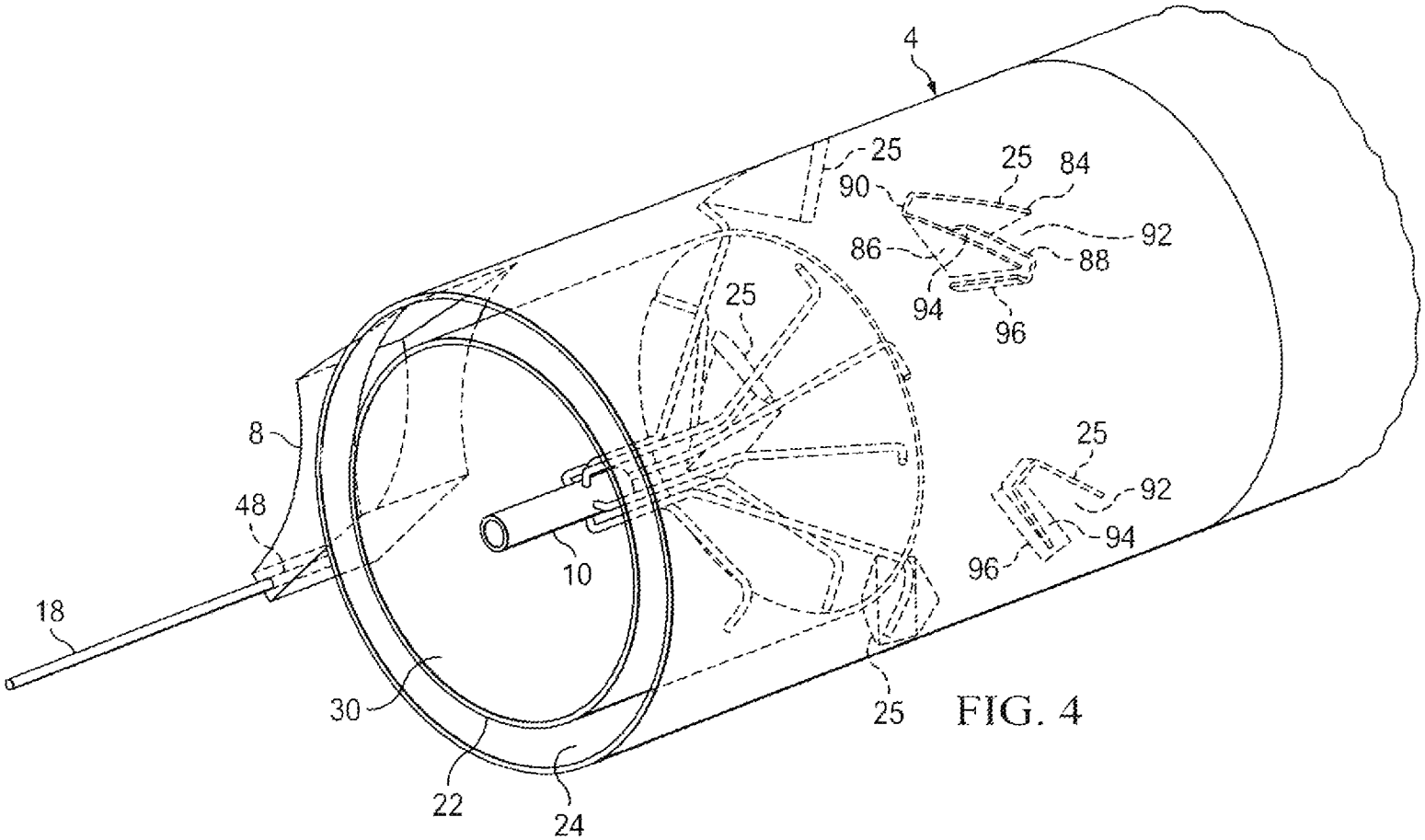
FIG. 4 is a perspective interior view of a rearward end portion of an initial cylindrical pass 4 of the inventive cylindrical burner apparatus 2.
Figure 5:
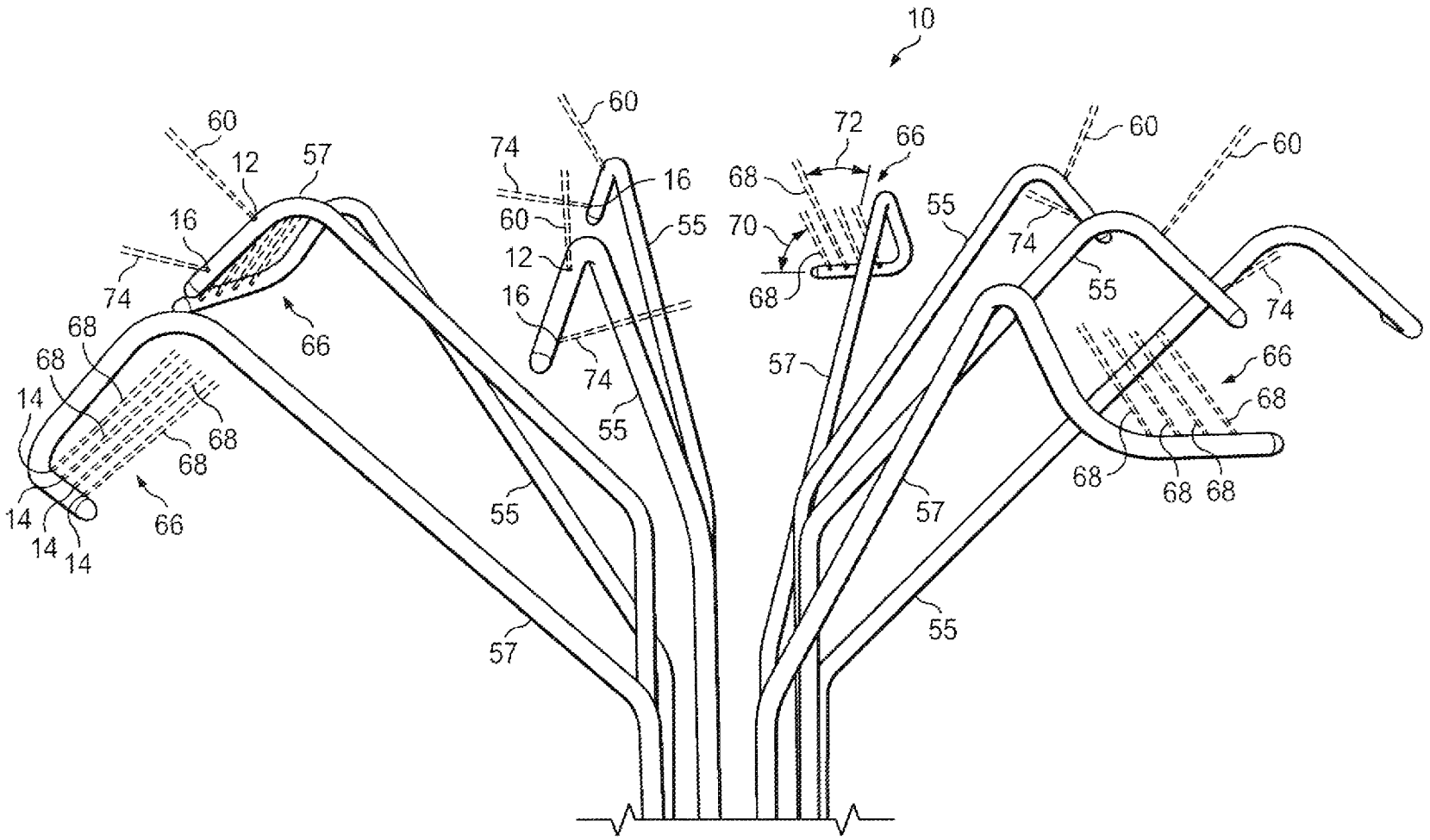
FIG. 5 is a top view of an embodiment 10 of a first fuel ejection assembly used in the inventive cylindrical burner apparatus 2.
Figure 6:
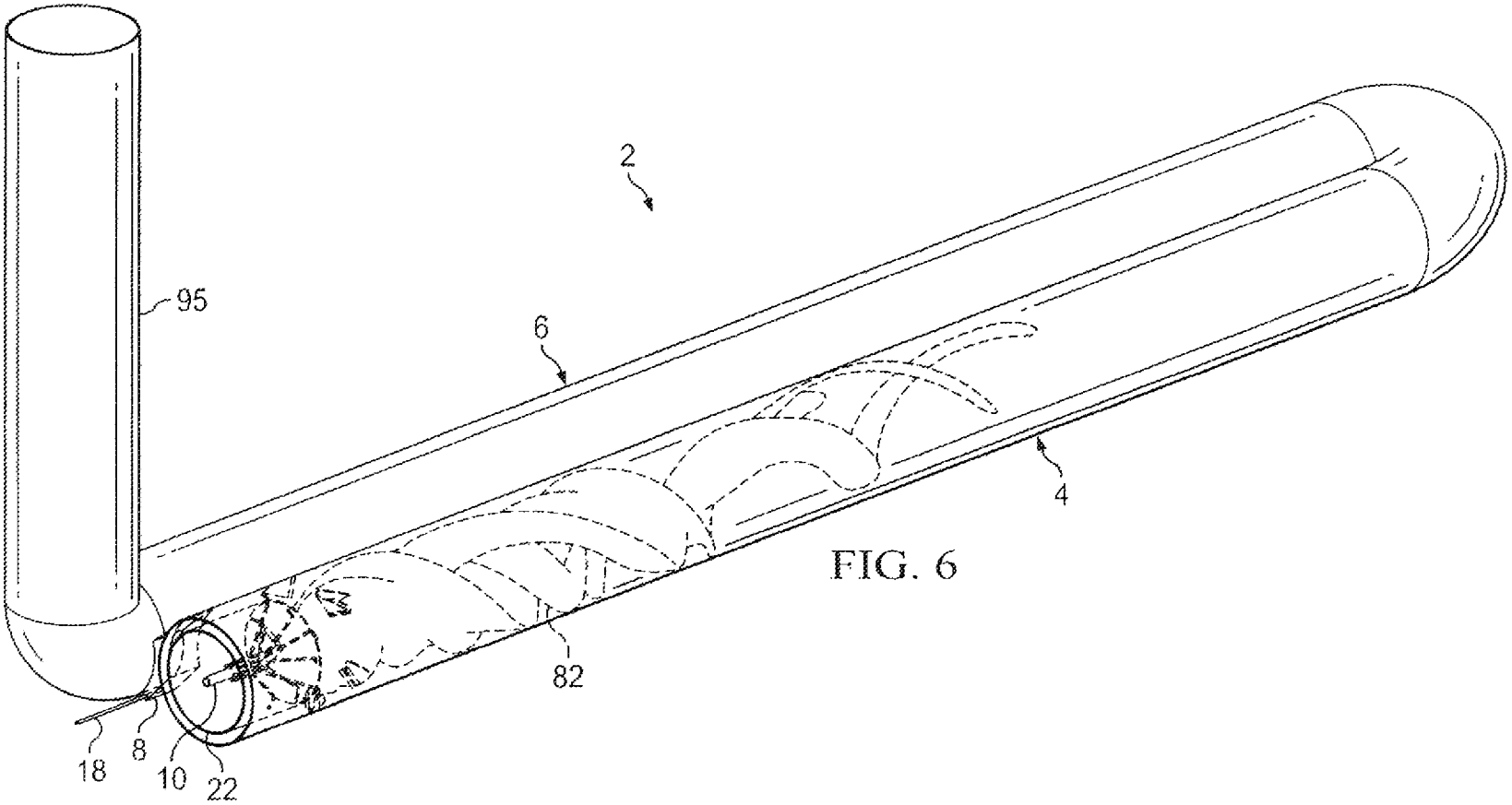
FIG. 6 is a perspective view of the inventive cylindrical burner apparatus 2 showing a swirling flame regime 82 which is produced in the initial tube pass 4.

The first fuel ejection structure, assembly or array 10 can be any type of ejection structure or collection or arrangement of ejector elements which provides at least some primary fuel jet discharge ports 12, 14, and/or 16 which (a) are positioned in the initial tube pass 4 forwardly of the rearward end 52 thereof, and forwardly of the discharge 36 of the FGR duct 8, and (b) are effective for discharging jets of gas fuel which will induce the flow of combustion air into the rearward end 52 of the initial tube pass 4 such that the combustion air preferably flows through the longitudinally extending air flow passageway 30 of the interior sleeve 22. The primary fuel jet discharge ports 12, 14 and 16 can be provided by ejection nozzles, ejector tips, ejection flow apertures formed in gas pipes or conduits, other ejection structures or elements, or any combination thereof. As seen in FIGS. 2-4, the first fuel ejection assembly 10 used in the embodiment 2 of the inventive apparatus comprises alternating sets of (a) five evenly spaced tubes 55 having the primary fuel jet discharge ports 12 and 16 formed therein and (b) five evenly spaced tubes 57 which provide the primary fuel jet discharge ports 14.

The first fuel ejection structure, assembly, or array 10 will preferably provide from three to ten, more preferably five, primary jet discharge ports 12 which are evenly spaced around the interior 35 of the initial tube pass 4. The primary fuel jet discharge ports 12 will preferably be positioned at, forwardly of, or within the forward discharge end 54 of the interior sleeve 22, or forwardly of the forward discharge end 56 of the interior annulus 24. The primary fuel discharge ports 12 will more preferably be positioned forwardly of the discharge 54 of the air passageway 30 of the interior sleeve 22 and will also preferably be positioned outwardly at a radial distance 58 which is at least one half of the distance from the longitudinal axis 5 to the interior wall 28 of the initial tube pass 4.

Each of the primary fuel jet discharge ports 12 is preferably oriented to discharge a jet 60 of the gas fuel forwardly at a forward angle 62 in the range of from 45° to 90° with respect to a plane extending through the discharge port 12 which is perpendicular to the longitudinal axis 5. The forward discharge angle 62 of the jets 60 will more preferably be in the range of from 55° to 80°. In addition, each of the primary fuel jet discharge ports 12 (a) preferably discharges the fuel jet 60 toward a flame stabilization structure 25 and (b) is also preferably oriented to discharge the fuel jet 60 toward the direction of rotation 44 of the swirling flow 42 at an angle 64 in the range of from 3° to 15° with respect to a radial line, perpendicular to the longitudinal axis 5, which extends from the longitudinal axis 5 through the discharge port 12.

The first fuel ejection structure, assembly, or array 10 will also preferably provide from three to thirty-two primary fuel jet discharge ports 14 which are evenly spaced around the interior 35 of the initial tube pass 4 either individually or in groups. The primary fuel jet discharge ports 14 will preferably by arranged in five evenly spaced groups 66 having four discharge ports 14 each. Each of the primary fuel jet discharge ports 14 will preferably be located in the forward end portion of the interior annulus 24 and will preferably be oriented to discharge a gas fuel jet 68 forwardly at an inward angle 70 in the range of from 20° to 80° (more preferably in the range of from 30° to 60° and most preferably about 45° (i.e., within +3°)) with respect to a plane extending through the discharge port 14 which is perpendicular to the longitudinal axis 5. Each of the primary fuel jet discharge ports 14 is also preferably oriented to discharge the gas fuel jets 68 at an angle 72 in a range of from 3° to 15° (with respect to a radial line, perpendicular to the longitudinal axis 5, which extends from the longitudinal axis 5 through the discharge port 14) in the direction of rotation 44 of the swirling flow 42.

In addition, the first fuel ejection structure, assembly, or array 10 preferably provides from three to ten, more preferably five, primary fuel jet discharge ports 16 which are evenly spaced around the interior 35 of the initial tube pass 4 and are oriented to discharge gas fuel jets 74 which are directed tangentially in the initial tube pass 4 in the direction of rotation 44. The primary fuel jet discharge ports 16 will preferably be positioned at, forwardly of, or within the forward discharge end 54 of the interior sleeve 22 or the forward discharge end 56 of the interior annulus 24. Each of the primary fuel discharge ports 16 is also preferably (a) positioned outwardly within the initial tube pass 4 at a radial distance which is at least two thirds of the distance from the longitudinal axis 5 to the interior wall 28 of the initial tube pass 4 and (b) oriented such that the tangential gas fuel jet 74 discharged therefrom is also directed forwardly at an angle 78 in the range of from 5° to 20° with respect to a plane 80 which extends through the fuel discharge port 16 and is perpendicular to the longitudinal axis 5.

The primary fuel jet discharge ports 12 and 16 are preferably larger than the primary fuel jet discharge ports 14. The fuel jet discharge ports 12 and 16 are preferably $1/32^{nd}$ inch holes and the fuel jet discharge ports 14 are preferably $1/64^{th}$ inch.

The second fuel ejection structure, assembly, or array 18 preferably provides from 5 to 20, more preferably from 8 to 16, secondary fuel jet discharge ports 20 which are preferably the same size as the primary fuel jet discharge ports 12 and 16. The number and/or size of the primary fuel jet discharge ports 12, 14 and 16 versus the secondary fuel jet discharge ports 20 will preferably be such that the amount of gas fuel discharged from the secondary jet discharge ports 20 will be from 10% to 70%, more preferably from 30% to 60% and more preferably about 50% (i.e., within ±5%), of the amount of gas fuel discharged from the primary jet discharge ports 12, 14, and 16.

Each of the flame stabilization structures 25 can be any type of structure, and can be positioned at any location, which is effective for (a) stabilizing the swirling flame 82 which projects forwardly in the initial tube pass 4 from the interior sleeve 22 and (b) preventing flame-outs. The flame stabilization structures 25 will preferably be configured and positioned such that they will be quickly heated by the combustion of the gas fuel to a temperature exceeding 2000° F. The flame stabilization structures 22 are preferably positioned outwardly on or within six inches of the interior wall 28 of the initial tube pass 4, and forwardly of the forward discharge end 56 of the interior annulus 24.

Each of the flame stabilization structures 25 is preferably a baffle structure comprising three baffle plates 84, 86, and 88. Plates 84 and 86 are connected by a common end wall 90 and are spaced apart such that plate 86 preferably diverges from plate 84 at an angle of from 5° to 20° as the plates 84 and 86 extend from the end wall 90. The baffle plate 88 is positioned between the plates 84 and 86, and is spaced apart from the end wall 90 such that a first flow channel 92 is formed between plates 84 and 88 and a connected second flow channel 94 is formed between plates 88 and 86. The baffle plate 88 also has an L-shaped lip 96 which extends from the end of the plate 88 opposite the end wall 90 of the plates 84 and 88. The L-shaped lip 96 operates to (a) scoop some of the gas fuel, air, and combustion products flowing in the interior 35 of the initial tube pass 4 into the baffle structure 25 and (b) deflect the collected gases so that the collected gases flow in one direction through the first flow channel 92 and then in the opposite direction through the second flow channel 94 of the flame stabilization baffle 25.

In the method of the present invention, a flow of combustion air is induced, without dependence on natural draft and without the use of a blower, into the rearward end 52 of the initial tube pass 4, and through the air passageway 30 of the interior sleeve 22, by discharging natural gas or any other gas fuel into the initial tube pass 4 from the primary fuel jet discharge ports 12, and preferably also from the primary fuel jet discharge ports 14 and/or 16. At the same time, the flow of recycled flue gas 38 via the FGR duct 8 from the subsequent tube pass 6 into the interior annulus 24 of the initial tube pass 4 is induced by discharging the jets of gas fuel 46 from the secondary fuel jet discharge ports 20.

The flow of recycled flue gas 38 combined with the gas fuel 46 discharged from the secondary jet discharge ports 20 is preferably delivered into the interior annulus 24 of the initial tube pass 4 in a tangential orientation which produces the swirling flow 42 around, and out of the forward discharge end 56 of, the interior annulus 24. The swirling flow 42 encircles the longitudinal axis 5 of the initial tube pass 4 and also produces the swirling flame 82 in the initial tube pass 4 which extends forwardly through most of the length of the initial tube pass 4 from the forward end 54 of the interior sleeve 22. The combustion gases (flue gases) produced by the combustion process then flow through the subsequent tube pass 6 and are discharged from a short, upwardly extending exhaust pipe or stack 95 which need only be tall enough (preferably not more than eight feet above a flame arrestor (not shown) on the air inlet at the rearward end 52 of the initial tube pass 4) to prevent the exhaust discharged from the upper end of the pipe or stack 95 from being draw into the air inlet.

The recycled flue gas 38 dilutes the combustion mixture and thus significantly reduces the amount of $NO_x$ emissions produce by the inventive cylindrical burner 2. The amount of flue gas recirculation produced by in the inventive cylindrical burner apparatus will typically be in the range of from 20% to 60% by volume of the total volume of gas fuel in the combustion mixture.

$NO_x$ emissions are also significantly reduced in the inventive apparatus 2 due to the fuel injection locations and orientations in the apparatus 2, in conjunction with the swirling flow regime 42 established in the initial pass 42. The outer swirling flow of the secondary gas fuel 40 and recycled flue gas 38 leaving the interior annulus 24, combined with the outer locations and orientations of the primary fuel jet discharge ports 12, 14, and 16, cause the diluted gas fuel to mix with the combustion air stream discharged from the central air passageway 30 in a delayed manner which begins in the form of a ring-shaped zone surrounding the air flow stream and is subsequently dominated by the swirling flow pattern of the gasses as the forward flow of the combustion gases continues down the initial tube pass 4. This delayed mixing reduces $NO_x$ emissions by reducing the peak flame temperatures produced in the initial tube pass 4.

Figure 7:
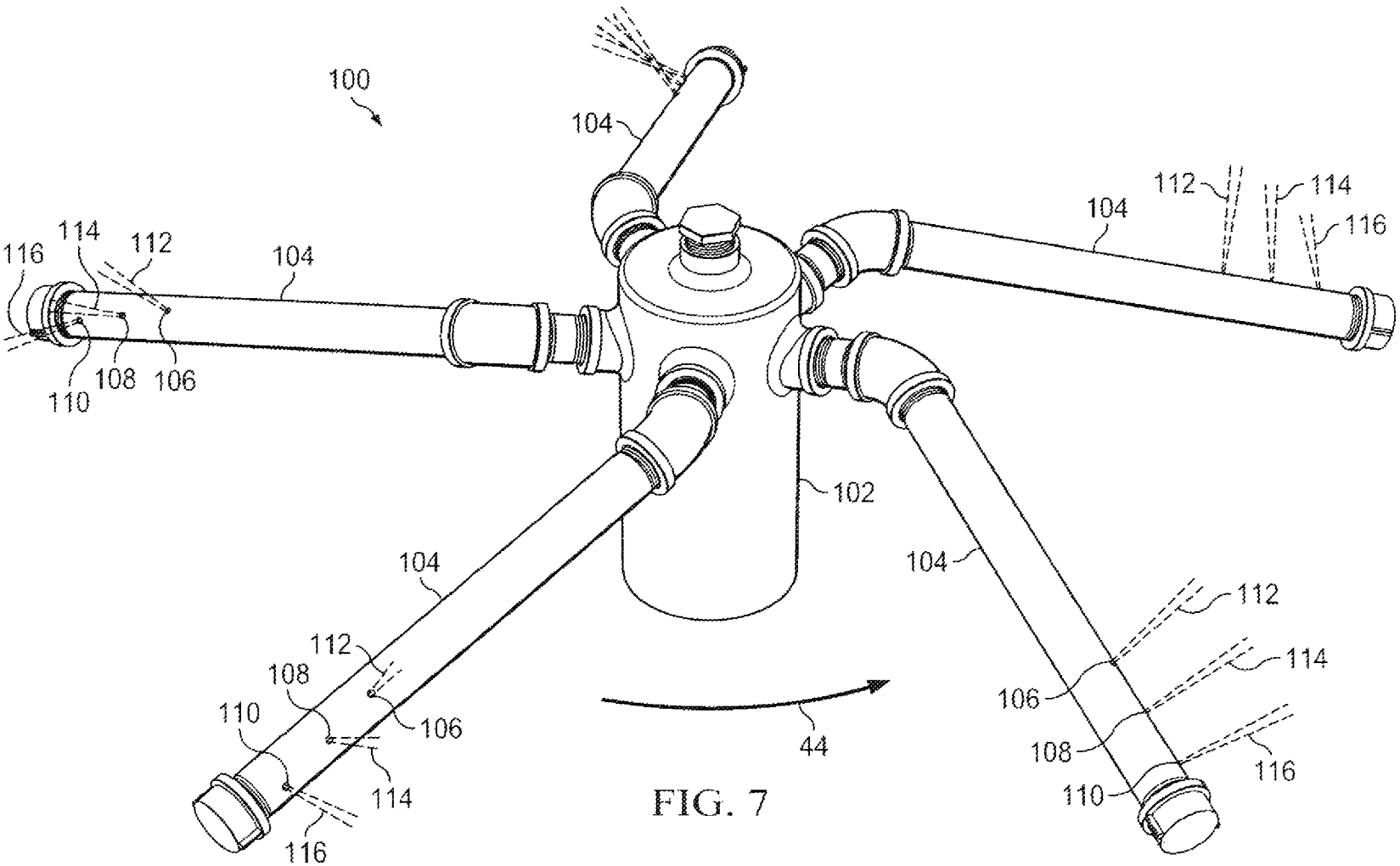
FIG. 7 is an elevational front view of an alternative embodiment 100 of the first fuel ejection assembly used in the inventive cylindrical burner apparatus 2.
Figure 8:
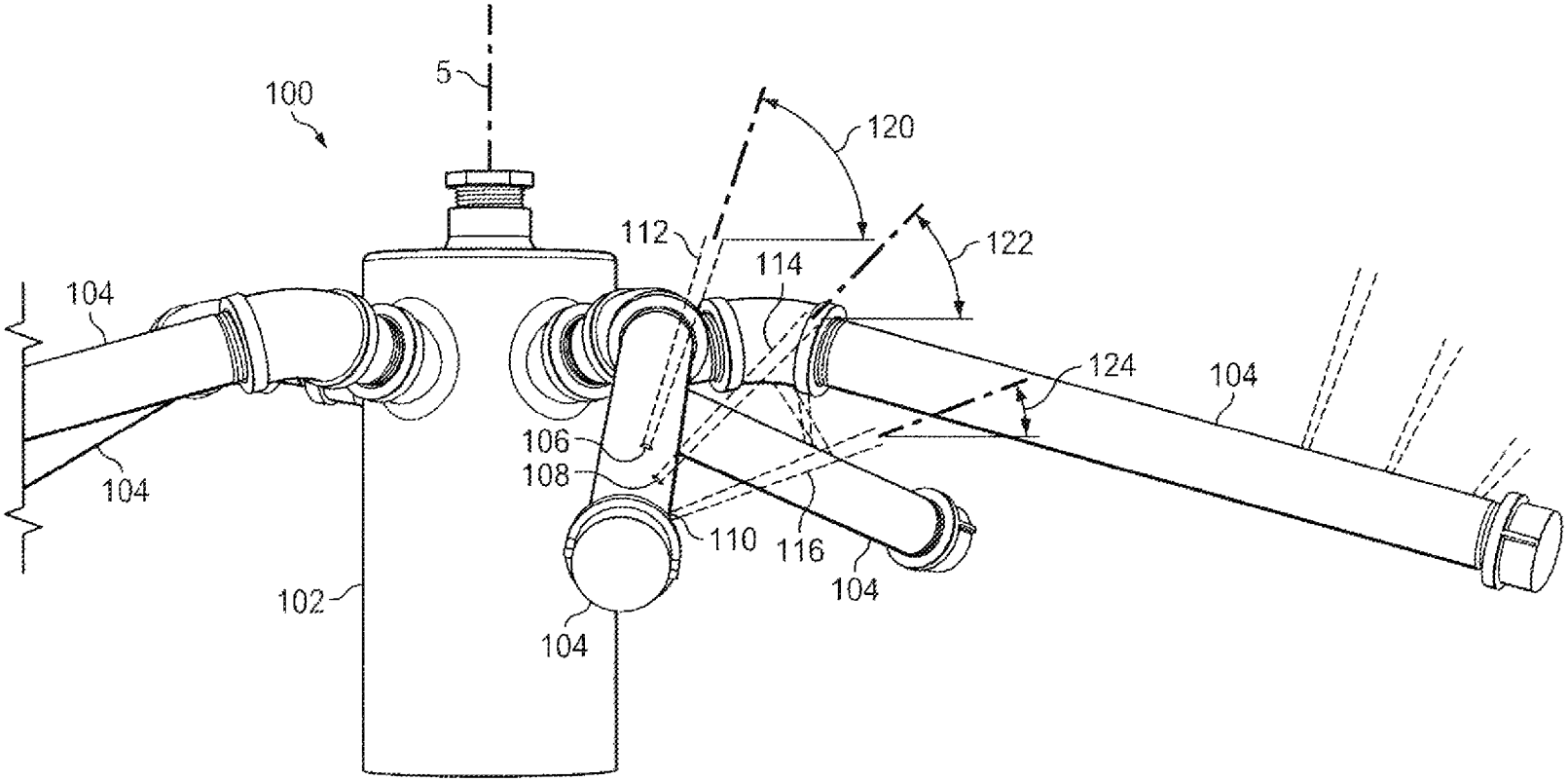
FIG. 8 is top view of the alternative fuel ejection assembly 100.

An alternative embodiment 100 of a fuel ejection assembly for use in the inventive cylindrical burner apparatus 2 is illustrated in FIGS. 7 and 8. The alternative fuel ejection assembly 100 replaces the first fuel ejection assembly 10 described above. The fuel ejection assembly 100 will be centrally positioned in the initial tube pass 4, forwardly of the rearward end 52 thereof, and is well suited for use with or without an interior sleeve 22, an interior annulus 24, an FGR duct 8, or a second fuel ejection structure, assembly or array 18.

The fuel ejection assembly 100 preferably comprises a central gas supply hub 102 and a plurality of, preferably 5, gas pipes or other gas conduits 104 which extend radially outward from the central hub 102. The radial gas conduits 104 can be curved, as illustrated in FIGS. 7 and 8, or can be straight. Each radial gas conduit 104 preferably has a plurality of primary fuel jet discharge ports 106, 108, and 110 which discharge jets 112, 114, and 116 of gas fuel forwardly and/or in the direction of rotation 44 in the initial tube pass 4 for inducing the flow of combustion air into the rearward end 52 of the initial tube pass 4 and for producing a swirling flame.

Each of the radial gas conduits 104 of the fuel ejection assembly 100 preferably comprises: (i) one or more fuel jet discharge ports 106 which each discharge a jet 112 of gas fuel tangentially in the direction of rotation and at a forward angle 120 in the range of from 60° to 90° (more preferably from 70° to 80°) with respect to a plane extending through the port 106 which is perpendicular to the longitudinal axis 5; (ii) one or more fuel jet discharge ports 108 which each discharge a jet 114 of gas fuel tangentially in the direction of rotation 44 and forwardly at a forward angle 122 in the range of from 25° to 65° (more preferably from 40° to 50°) with respect to a plane extending through the port 108 which is perpendicular to the longitudinal axis 5; and (iii) one or more fuel jet discharge ports 110 which each discharge a jet 116 of gas fuel tangentially in the direction of rotation 44 at a forward angle 124 in the range of from 0° to 30° (more preferably from 10° to 20°) with respect to a plane extending through the port 110 which is perpendicular to the longitudinal axis 5.

Figure 9:
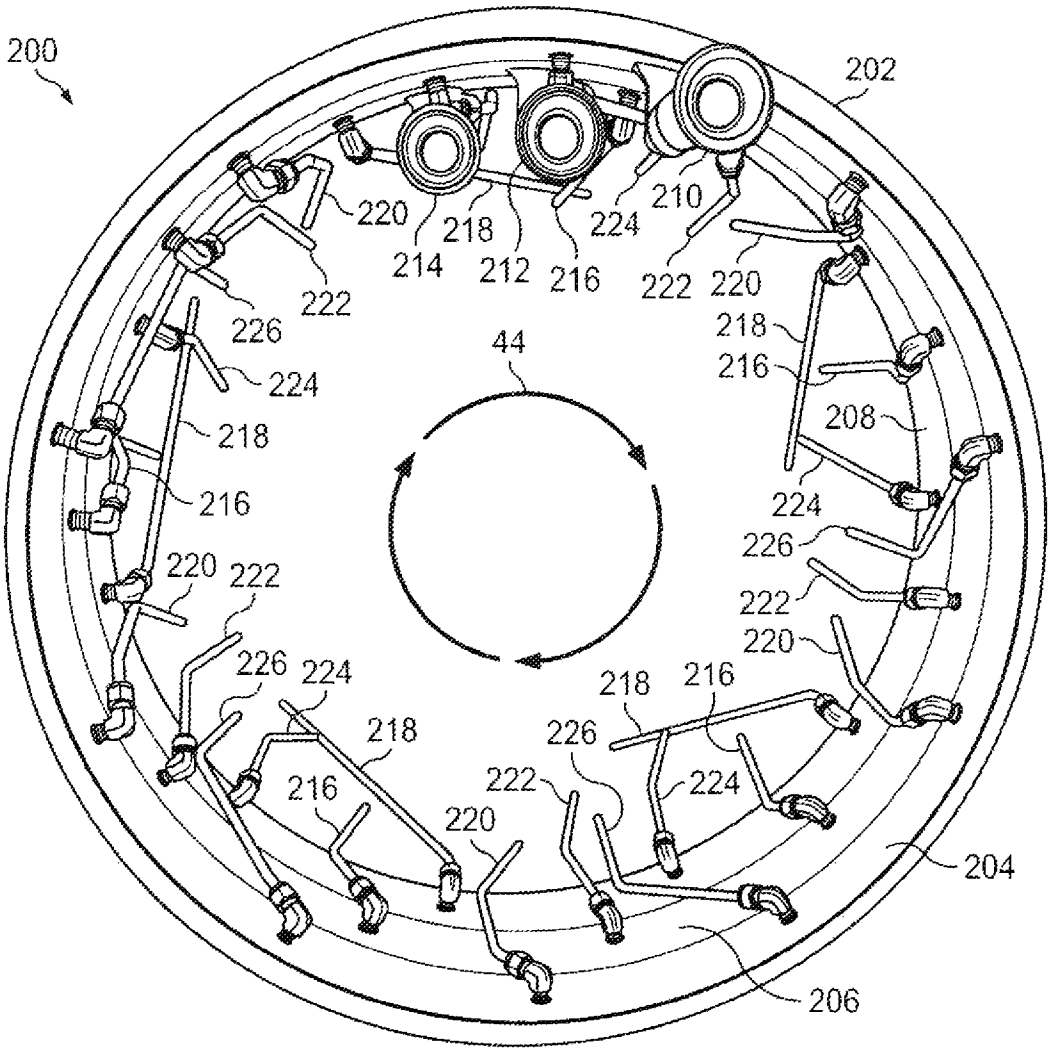
FIG. 9 is an elevational rear view of an alternative embodiment 200 of the first fuel ejection assembly used in the inventive cylindrical burner apparatus 2.
Figure 10:
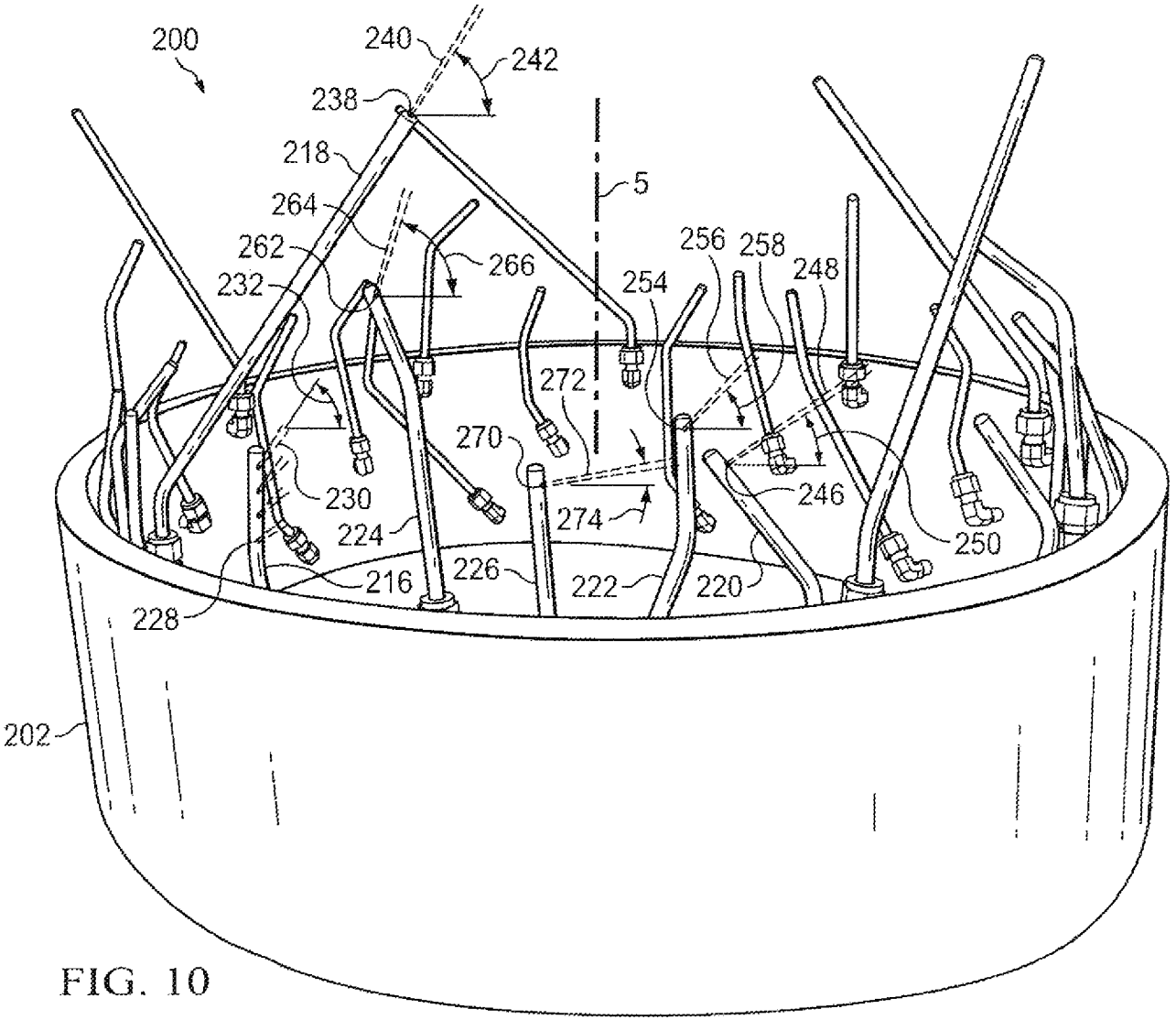
FIG. 10 is a top view of the alternative fuel ejection assembly 200.
Figure 11:
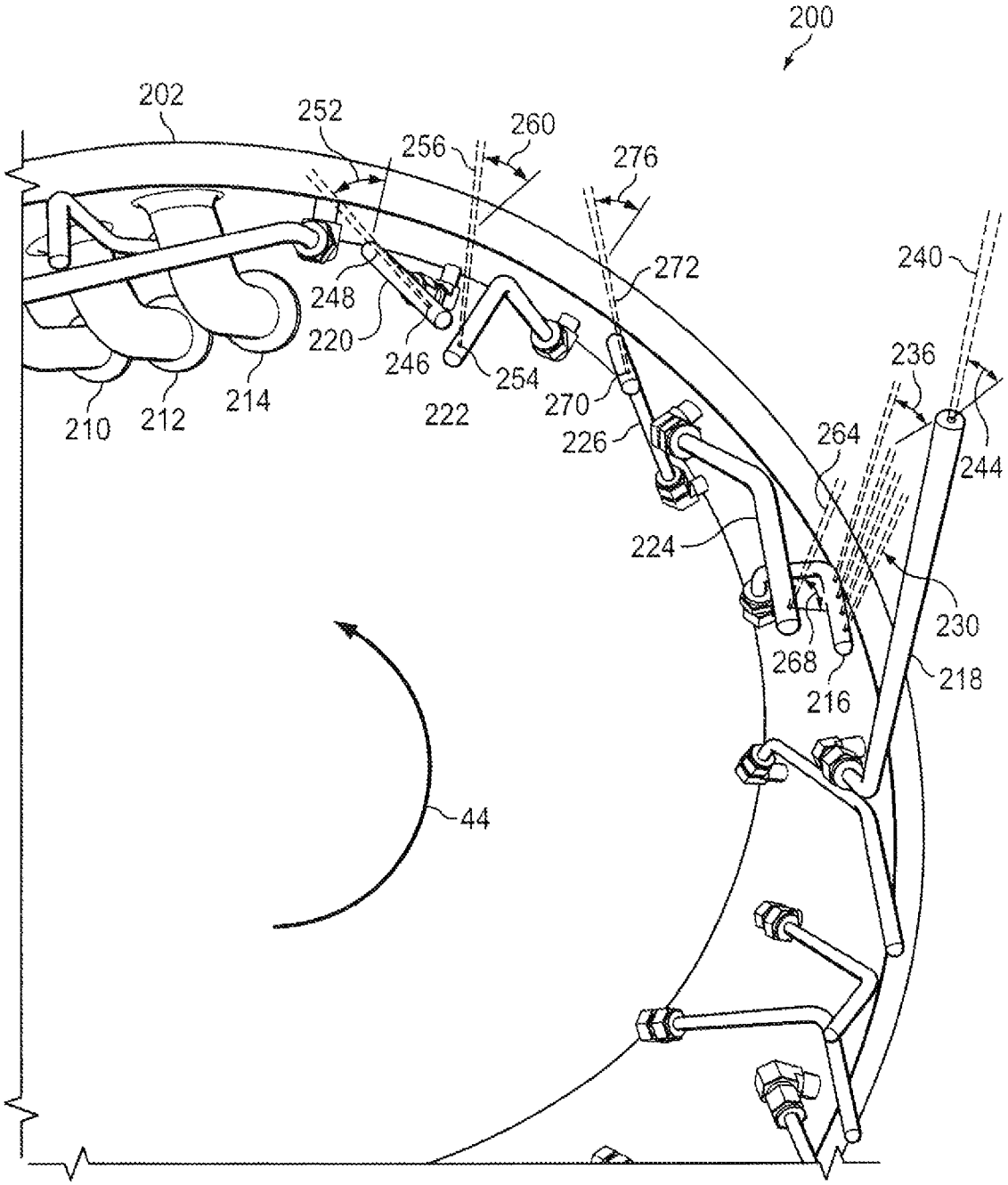
FIG. 11 is an elevational front view of the alternative fuel ejection assembly 200.

Another alternative embodiment 200 of a fuel ejection assembly for use in the inventive cylindrical burner apparatus 2 is illustrated in FIGS. 9-11. The alternative fuel ejection assembly 200 also replaces the first fuel ejection assembly 10, described above, and will preferably be positioned inside the forward end 54 of the air passageway 30 of the interior sleeve 26.

The fuel ejection assembly 200 preferably comprises: (a) a cylindrical gas fuel manifold 202 having a series of three circular fuel supply channels 204, 206, and 208 contained therein; (b) a gas fuel supply connection 210, 212, or 214 for each of the circular fuel supply channels 204, 206, and 208; (c) a plurality of (preferably at least three and more preferably five) ejector pipes or other conduits 216 which are connected to the middle circular fuel channel 206 and are evenly spaced around the cylindrical manifold 202; (d) a plurality of (preferably at least three and more preferably five) ejector pipes or other conduits 218 which are connected to the forward most circular fuel channel 208 and are evenly spaced around the cylindrical manifold 202; (e) a plurality of (preferably at least three and more preferably five) ejector pipes or other conduits 220 which are connected to the rearward most circular fuel channel 204 and are evenly spaced around the cylindrical manifold 202; (f) a plurality of (preferably at least three and more preferably five) ejector pipes or other conduits 222 which are connected to the middle circular fuel channel 206 and are evenly spaced around the cylindrical manifold 202; (g) a plurality of (preferably at least three and more preferably five) ejector pipes or other conduits 224 which are connected to the forward most circular fuel channel 208 and are evenly spaced around the cylindrical manifold 202; and (h) a plurality of (preferably at least three and more preferably five) ejector pipes or other conduits 226 which are connected to the rearward most circular fuel channel 204 and are evenly spaced around the cylindrical manifold 202.

Each of the ejector conduits 216 has one or more (preferably a plurality and more preferably four) fuel discharge ports 228 for discharging gas fuel jets 230. The fuel discharge ports 228 are preferably oriented to discharge each of the gas fuel jets 230 (a) forwardly at an angle 232 in the range of from 10° to 50° with respect of a plane which extends through the discharge port 228 and is perpendicular to the longitudinal axis 5 of the initial tube pass 4, and (b) toward the direction of rotation 44 of the swirling flow at an angle 236 in the range of from 40° to 90° with respect to a radial line, perpendicular to the longitudinal axis 5, which extends from the longitudinal axis 5 through the discharge port 228.

Each of the ejector conduits 218 has a fuel discharge port 238 for discharging a gas fuel jet 240. The fuel discharge port 238 is preferably oriented to discharge the gas fuel jet 240 (a) forwardly at an angle 242 in the range of from 20° to 90°, more preferably 30° to 70°, with respect of a plane which extends through the discharge port 238 and is perpendicular to the longitudinal axis 5 and (b) toward the direction of rotation 44 of the swirling flow at an angle 244 in the range of from 60° to 110° with respect to a radial line, perpendicular to the longitudinal axis 5, which extends from the longitudinal axis 5 through the discharge port 238. Each gas fuel jet 240 is also preferably directed toward a flame stabilization structure 25 in the initial tube pass 4. The fuel discharge ports 238 of the ejector conduits 218 are located in the initial tube pass 4 forwardly of the fuel discharge ports 228 of the ejector conduits 216.

Each of the ejector conduits 220 has a fuel discharge port 246 for discharging a gas fuel jet 248. The fuel discharge port 246 is preferably oriented to discharge the gas fuel jet 248 (a) forwardly at an angle 250 in the range of from 15° to 80°, more preferably 25° to 60°, with respect to a plane which extends through the discharge port 246 and is perpendicular to the longitudinal axis 5, and (b) toward the direction of rotation 44 of the swirling flow at an angle 252 in the range of from 600 to 1100 with respect to a radial line, perpendicular to the longitudinal axis 5, which extends from the longitudinal axis 5 through the discharge port 246. The fuel discharge ports 246 of the ejector conduits 220 are located in the initial tube pass 4 rearwardly of the fuel discharge ports 238 of the ejector conduits 218 and are preferably also located forwardly of the fuel discharge ports 228 of the ejector conduits 216.

Each of the ejector conduits 222 has a fuel discharge port 254 for discharging a gas fuel jet 256. The fuel discharge port 254 is preferably oriented to discharge the gas fuel jet 256 (a) forwardly at an angle 258 in the range of from 20° to 90°, more preferably 30° to 70°, with respect to a plane which extends through the discharge port 254 and is perpendicular to the longitudinal axis 5, and (b) toward the direction of rotation 44 of the swirling flow at an angle 260 in the range of from 50 to 55° with respect to a radial line, perpendicular to the longitudinal axis 5, which extends from the longitudinal axis 5 through the discharge port 254. The fuel discharge ports 254 of the ejector conduits 222 are located in the initial tube pass 4 rearwardly of the fuel discharge ports 238 of the ejector conduits 218 and are preferably also located forwardly of the fuel discharge ports 228 of the ejector conduits 216.

Each of the ejector conduits 224 has a fuel discharge port 262 for discharging a gas fuel jet 264. The fuel discharge port 262 is preferably oriented to discharge the gas fuel jet 264 (a) forwardly at an angle 266 in the range of from 40° to 90° more preferably 45° to 80°, with respect to a plane which extends through the discharge port 262 and is perpendicular to the longitudinal axis 5, and (b) toward the direction of rotation 44 of the swirling flow at an angle 268 in the range of from 20° to 70° with respect to a radial line, perpendicular to the longitudinal axis 5, which extends from the longitudinal axis 5 through the discharge port 262. The fuel discharge ports 262 of the ejector conduits 224 are located in the initial tube pass 4 rearwardly of the fuel discharge ports 238 of the ejector conduits 218 and are preferably also located forwardly of the fuel discharge ports 228 of the ejector conduits 216.

Each of the ejector conduits 226 has a fuel discharge port 270 for discharging a gas fuel jet 272. The fuel discharge port 270 is preferably oriented to discharge the gas fuel jet 272 (a) forwardly at an angle 274 in the range of from 0° to 45°, more preferably 3° to 25°, with respect to a plane which extends through the discharge port 270 and is perpendicular to the longitudinal axis 5, and (b) toward the direction of rotation 44 of the swirling flow at an angle 276 in the range of from 40° to 90° with respect to a radial line, perpendicular to the longitudinal axis 5, which extends from the longitudinal axis 5 through the discharge port 270. The fuel discharge ports 270 of the ejector conduits 226 are located in the initial tube pass 4 rearwardly of the fuel discharge ports 238 of the ejector conduits 218 and are preferably also located forwardly of the fuel discharge ports 228 of the ejector conduits 216.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as called for by the claims.

What is claimed is:

1. A method of operating a cylindrical burner comprising the steps of:

a) inducing a flow of combustion air into an interior of a straight initial tube pass of the cylindrical burner through a rearward end of the straight initial tube pass by discharging jets of a gas fuel from at least some of a plurality of fuel jet discharge ports, positioned in the interior of the straight initial tube pass forwardly of the rearward end, to provide an amount of induction and produce an amount of force which are sufficient to operate the cylindrical burner without natural daft and draw the flow of combustion air from outside of the cylindrical burner into the interior of the straight initial tube pass with no natural draft, the gas fuel discharged from the fuel jet discharge ports being combusted with the flow of combustion air in the interior of the straight initial tube pass to produce a flue gas which flows into a subsequent tube pass of the cylindrical burner, wherein the cylindrical burner does not include a blower which blows or draws air into the cylindrical burner and b) discharging at least a portion of the flue gas from an exhaust discharge of the cylindrical burner at or downstream of a downstream end of the subsequent tube pass, the fuel jet discharge ports comprising one or more first fuel jet discharge ports in the interior of the straight initial tube pass and one or more second fuel jet discharge ports in the interior of the straight initial tube pass, each of the one or more first fuel jet discharge ports being oriented to discharge a jet of the gas fuel in the interior of the straight initial tube pass at a first forward angle in a range of from 0° to 30° with respect to a plane extending through the first fuel jet discharge port which is perpendicular to a longitudinal axis of the straight initial tube pass, and each of the one or more second fuel jet discharge ports being oriented to discharge a jet of the gas fuel in the interior of the straight initial tube pass at a second forward angle, greater than the first forward angle, in a range of from 3° to 45° with respect to a plane extending through the second fuel jet discharge port which is perpendicular to the longitudinal axis.

2. The method of claim 1 further comprising one or more of the fuel jet discharge ports being oriented to produce a swirling flame in the interior of the straight initial tube pass, the swirling flame having a direction of rotation.

3. The method of claim 1 further comprising the exhaust discharge being located at an elevation which is not more than eight feet above an air inlet at the rearward end of the straight initial tube pass.

4. A method of operating a cylindrical burner comprising:

inducing a flow of combustion air into an interior of a straight initial tube pass of the cylindrical burner through a rearward end of the straight initial tube pass by discharging jets of a gas fuel from at least some of a plurality of fuel jet discharge ports, positioned in the interior of the straight initial tube pass forwardly of the rearward end, to provide an amount of induction and produce an amount of force which are sufficient to operate the cylindrical burner without natural draft and draw the flow of combustion air from outside of the cylindrical burner into the interior of the straight initial tube pass with no natural draft, the gas fuel discharged from the fuel jet discharge ports being combusted with the flow of combustion air in the interior of the straight initial tube pass to produce a flue gas which flows into a subsequent tube pass of the cylindrical burner, wherein the cylindrical burner does not include a blower which blows or draws air into the cylindrical burner;

the fuel jet discharge ports comprising one or more first fuel jet discharge ports in the interior of the straight initial tube pass and one or more second fuel jet discharge ports in the interior of the straight initial tube pass;

each of the one or more first fuel jet discharge ports being oriented to discharge a jet of the gas fuel in the interior of the straight initial tube pass at a first forward angle in a range of from 0° to 30° with respect to a plane extending through the first fuel jet discharge port which is perpendicular to a longitudinal axis of the straight initial tube pass; and each of the one or more second fuel jet discharge ports being oriented to discharge a jet of the gas fuel in the interior of the straight initial tube pass at a second forward angle, greater than the first forward angle, in a range of from 3° to 45° with respect to a plane extending through the second fuel jet discharge port which is perpendicular to the longitudinal axis.

* * * * *